US008561985B2

(12) United States Patent
Ishizaki et al.

(10) Patent No.: US 8,561,985 B2
(45) Date of Patent: Oct. 22, 2013

(54) CONVEYING DEVICE, IMAGE FORMING APPARATUS, AND PROGRAM

(75) Inventors: Yuusuke Ishizaki, Kanagawa (JP); Takahisa Koike, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 267 days.

(21) Appl. No.: 13/006,737

(22) Filed: Jan. 14, 2011

(65) Prior Publication Data

US 2011/0176846 A1 Jul. 21, 2011

(30) Foreign Application Priority Data

Jan. 19, 2010 (JP) ..... 2010-009440
Dec. 16, 2010 (JP) ..... 2010-280770

(51) Int. Cl.
*B65H 5/34* (2006.01)

(52) U.S. Cl.
USPC ..... 271/270; 271/265.01; 399/21

(58) Field of Classification Search
USPC ..... 271/270, 265.01; 399/21
See application file for complete search history.

(56) References Cited

U.S. PATENT DOCUMENTS 5,575,466 A * 11/1996 Tranquilla ..... 271/10.03
6,409,043 B1 * 6/2002 Fujita et al. ..... 271/10.03
2003/0173736 A1 9/2003 Yano
2004/0080100 A1 4/2004 DePoi et al.
2004/0217541 A1 11/2004 Horio

FOREIGN PATENT DOCUMENTS

CN 101320231 A 12/2008
JP 4235124 12/2008

OTHER PUBLICATIONS

Chinese Office Action Issued Mar. 5, 2013 in Patent Application No. 201110021143.7 (with English translation).
Extended European Search Report issued Apr. 5, 2013, in European Patent Application No. 11150463.5.

* cited by examiner

*Primary Examiner* — Michael McCullough
(74) *Attorney, Agent, or Firm* — Oblon, Spivak, McClelland, Maier & Neustadt, L.L.P.

(57) ABSTRACT

An image forming apparatus includes a feed unit, a sensor, a control unit, a measuring unit, and a determining unit. The feed unit 1 conveys a sheet. The sensor detects the sheet being conveyed. The control unit controls to change the force acting on the sheet from that is in normal conveyance of the sheet. The measuring unit measures a measurement value related to conveyance speed of the detected sheet with the acting force changed. The determining unit determines whether there is an indication of abnormality in conveyance of the sheet on the basis of the measurement value.

10 Claims, 11 Drawing Sheets

CONVEYING DEVICE, IMAGE FORMING APPARATUS, AND PROGRAM

CROSS-REFERENCE TO RELATED APPLICATIONS

The present application claims priority to and incorporates by reference the entire contents of Japanese Patent Application No. 2010-009440 filed in Japan on Jan. 19, 2010 and Japanese Patent Application No. 2010-280770 filed in Japan on Dec. 16, 2010.

BACKGROUND OF THE INVENTION

1. Field of the Invention

The present invention relates to a conveying device, an image forming apparatus, and a program.

2. Description of the Related Art

Conventionally, a roller, a belt, or the like, which is made of rubber, polyurethane, or the like, is used on a conveying path on which a recording medium such as a sheet is conveyed in an automatic document feeder (ADF) or the like of a printer or a scanner. With increasing the number of sheets conveyed, the surface of the roller or the like becomes worn, and this may cause the sheet to slip. In addition, paper dust and a foreign substance, etc. attached to the surface of the sheet, the roller, or the like may sometimes cause the sheet to slip.

If conveyance efficiency decreases due to the slip, the ADF fails to convey a sheet at predetermined timing, and this may result in a sheet jam.

To cope with such problems, in Japanese Patent No. 4235124, there has been disclosed the invention of an image forming apparatus including a sensor for detecting delay in conveyance of a sheet on a conveying path; if an amount of delay exceeds a predetermined value, the image forming apparatus displays a message prompting replacement of a rotating member such as a roller.

However, in the invention of the image forming apparatus disclosed in Japanese Patent No. 4235124, by the time the delay in conveyance of the sheet is detected, abnormality in the rotating member on the conveying path has already arisen, and downtime of the image forming apparatus may occur.

The downtime is a time from when a function of the image forming apparatus, such as a copy function, becomes disabled and a user calls a maintenance agency for maintenance work until the function of the image forming apparatus becomes available to use again thanks to maintenance work. If a user calls for maintenance work after occurrence of a downtime of the image forming apparatus, the down time may lengthen.

So, early detection of abnormality in the rotating member enables the user to call the maintenance agency at an early stage. This makes it possible to shorten the down time. Furthermore, by adjusting a time required for the maintenance work to convenience of the user, downtime may be prevented from occurring during a time when the user uses the image forming apparatus.

Therefore, for the purpose of predicting the occurrence of abnormality in a conveying member, a threshold value used for detection of delay may sometimes be lowered. However, if a time from when an amount of delay exceeding the predetermined value is detected until a slip resulting in the occurrence of a sheet jam occurs is too short, it is not possible to achieve the purpose of predicting a sheet jam.

SUMMARY OF THE INVENTION

It is an object of the present invention to at least partially solve the problems in the conventional technology.

According to an aspect of the present invention, a conveying device comprises: a conveying unit that conveys a recording medium; a detecting unit that detects the recording medium being conveyed; a control unit that controls to change a force acting on the recording medium from that is in normal conveyance of the recording medium; a measuring unit that measures a measurement value related to conveyance speed of the detected recording medium with the acting force changed; and a determining unit that determines whether there is an indication of abnormality in conveyance of the recording medium on the basis of the measurement value.

According to another aspect of the present invention, an image forming apparatus comprises: a conveying device that conveys a recording medium; and an image forming unit that forms an image on the recording medium being conveyed, and the conveying device includes a conveying unit that conveys a recording medium; a detecting unit that detects the recording medium being conveyed; a control unit that controls to change a force acting on the recording medium from that is in normal conveyance of the recording medium; a measuring unit that measures a measurement value related to conveyance speed of the detected recording medium with the acting force changed; and a determining unit that determines whether there is an indication of abnormality in conveyance of the recording medium on the basis of the measurement value.

According to still another aspect of the present invention, a program causing a computer to execute: detecting a recording medium being conveyed; controlling to change a force acting on the recording medium from that is in normal conveyance of the recording medium; measuring a measurement value related to conveyance speed of the detected recording medium with the acting force changed; and determining whether there is an indication of abnormality in conveyance of the recording medium on the basis of the measurement value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
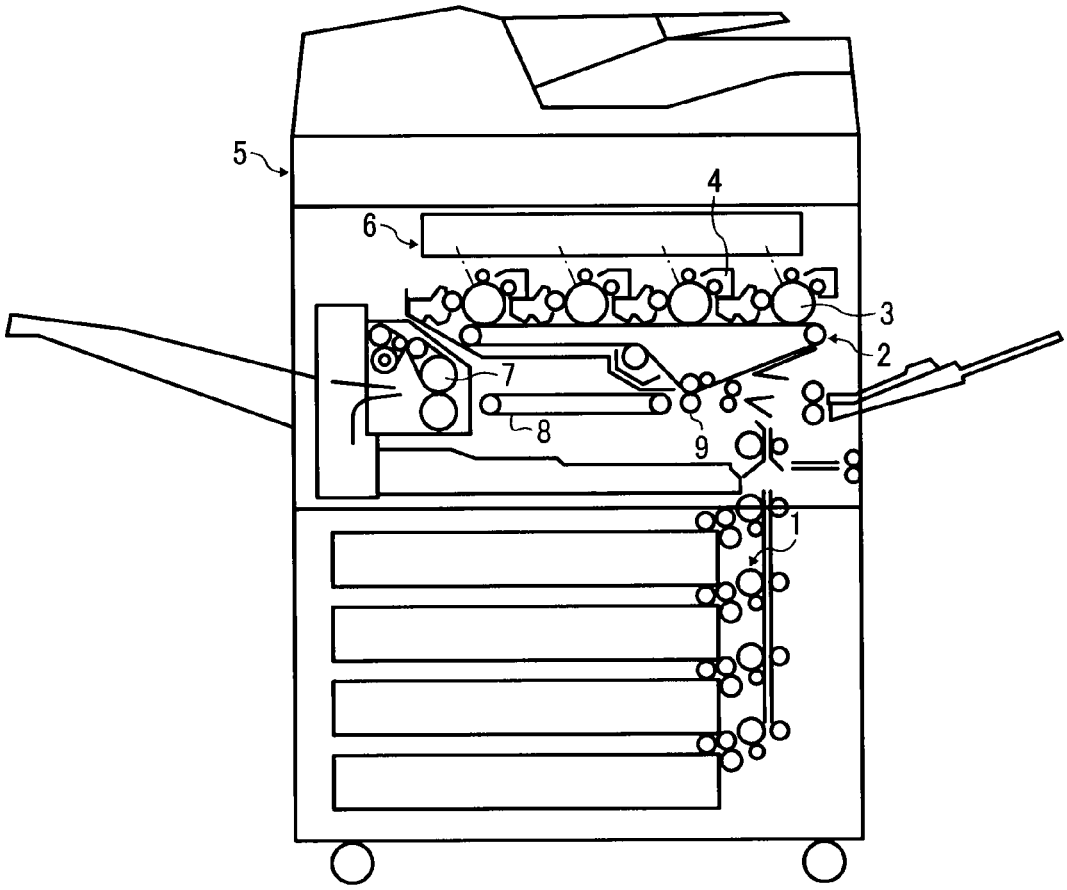
FIG. 1 is a diagram illustrating a configuration of an entire image forming apparatus including a sheet conveying device according to a first embodiment.

Exemplary embodiments of a conveying device, an image forming apparatus, and a program according to the present invention are explained in detail below with reference to the accompanying drawings. In the embodiments described below, a "conveying member" means a member used to convey a sheet on a conveying path, and includes a member which conveys a sheet by having direct contact with the sheet, a member which drives a member having direct contact with a sheet, and the like.

The embodiments of the present invention are explained below with reference to the accompanying drawings.

Incidentally, in the present specification and the drawings, components having substantially the same functional configuration are denoted by the same reference numerals to avoid repetition in a description of the components.

First Embodiment

FIG. 1 is a diagram illustrating a configuration of an entire image forming apparatus including a sheet conveying device according to a first embodiment. The image forming apparatus shown in FIG. 1 includes: a feed unit 1; a primary transfer unit 2; a photosensitive element unit 3; a developing unit 4; a scanner unit 5; an image writing unit 6; a fixing unit 7; a conveying unit 8; and a sheet transfer unit 9.

The feed unit 1 picks up a sheet stored in a sheet tray one by one, and leads the sheet into the conveying unit 8. The primary transfer unit 2 transfers a toner image, developed on the photosensitive element unit 3, onto a primary transfer belt. In a case of a full-color copy, four color toner images are sequentially transferred onto the primary transfer belt in a superimposed manner.

In the present first embodiment, the conveying device according to the present invention is applied to the feed unit 1. Incidentally, the present invention is not limited to this configuration; alternatively, the conveying device according to the present invention may be applied to the conveying unit 8.

The photosensitive element unit 3 is a rotating drum. After the photosensitive element unit 3 is uniformly charged, the photosensitive element unit 3 is exposed to a laser beam emitted from the image writing unit 6, and a latent image is formed on the photosensitive element unit 3. Then, in the developing unit 4, toner is made to adhere onto the latent image, and a toner image is formed on the surface of the photosensitive element unit 3.

The scanner unit 5 optically scans an image formed on a medium, and outputs image data. At the time of execution of a copy, the image data output from the scanner unit 5 is processed by an image processing unit (not shown), and the processed image data is input to the image writing unit 6. Incidentally, the image processing unit performs a gamma correction, a color space conversion, an image separation processing, a tone correction processing, and the like.

The fixing unit 7 applies heat and pressure to a sheet onto which a toner image is transferred to fix the toner on the sheet. The fixing unit 7 includes a fixing roller and a pressure roller.

The conveying unit 8 conveys a sheet which is fed by the feed unit 1 and onto which a toner image is transferred by the sheet transfer unit 9.

The sheet transfer unit 9 transfers a toner image formed on the primary transfer belt onto a sheet being conveyed by the conveying unit 8. In a case of a full-color copy, upon completion of the transfer of the toner image onto the primary transfer belt by the primary transfer unit 2, a sheet is fed by the feed unit 1. The toner image on the primary transfer belt is transferred onto the sheet by the sheet transfer unit 9. Subsequently, the sheet is conveyed to the fixing unit 7 by the conveying unit 8, and toner of the toner image is fixed on the sheet by the fixing unit 7.

Figure 2:
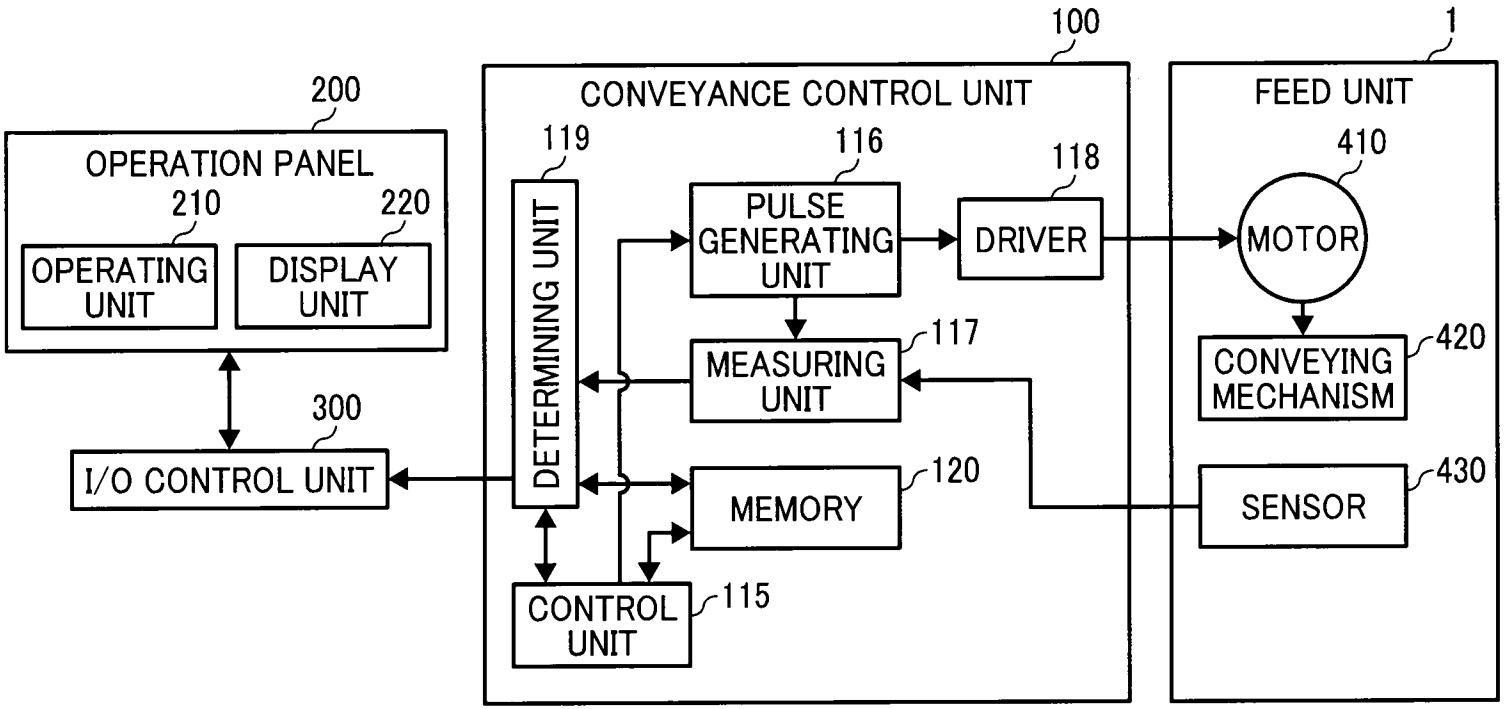
FIG. 2 is a block diagram illustrating functional configurations of a conveyance control unit and an operation panel according to the first embodiment.

FIG. 2 is a block diagram illustrating functional configurations of a conveyance control unit 100 for controlling driving of the feed unit 1 as the conveying device and an operation panel 200.

The operation panel 200 includes an operating unit 210 and a display unit 220. The operating unit 210 is a numerical keypad, operation buttons, and the like. An instruction to the image forming apparatus or information to be set at the time of execution of a job, etc. is input through the operating unit 210. The display unit 220 displays thereon a status of the image forming apparatus and the like. Furthermore, the display unit 220 displays thereon a screen prompting an operator to input an instruction to the image forming apparatus or the like. The operator inputs an instruction, information to be set, and the like in accordance with the displayed screen.

An input/output (I/O) control unit 300 performs display control on the display unit 220 of the operation panel 200 and input control on the operating unit 210 of the operation panel 200. Specifically, the I/O control unit 300 receives various screens or data to be displayed on the display unit 220 from the conveyance control unit 100, and controls to display the received screen or data on the display unit 220. Furthermore, the I/O control unit 300 receives an input of a key event of the key or operation button, etc. on the operating unit 210 made by an operator, and sends the input instruction or information to the conveyance control unit 100.

As shown in FIG. 2, the feed unit 1 mainly includes a motor 410, a conveying mechanism 420, and a sensor 430.

Figure 3:
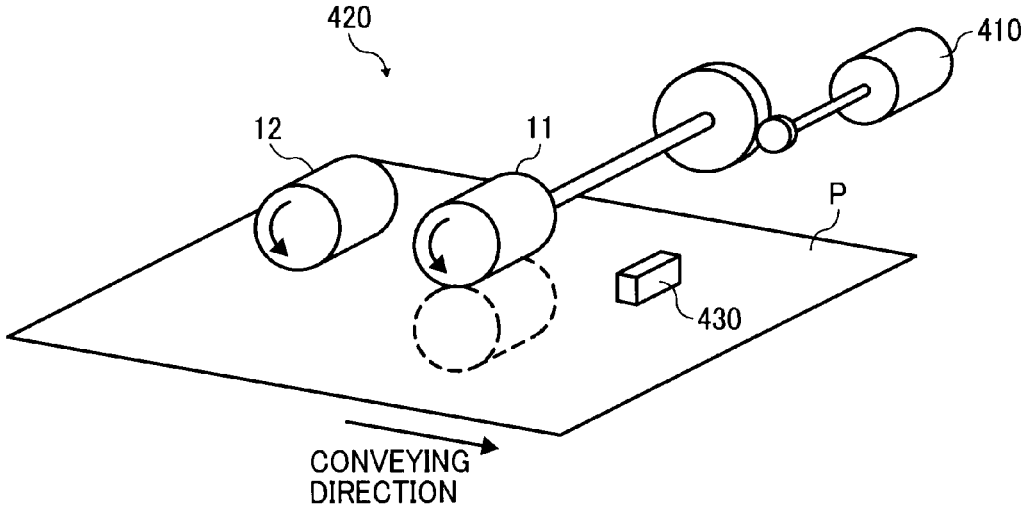
FIG. 3 is a schematic diagram illustrating a general configuration of a conveying mechanism according to the first embodiment.
Figure 4:
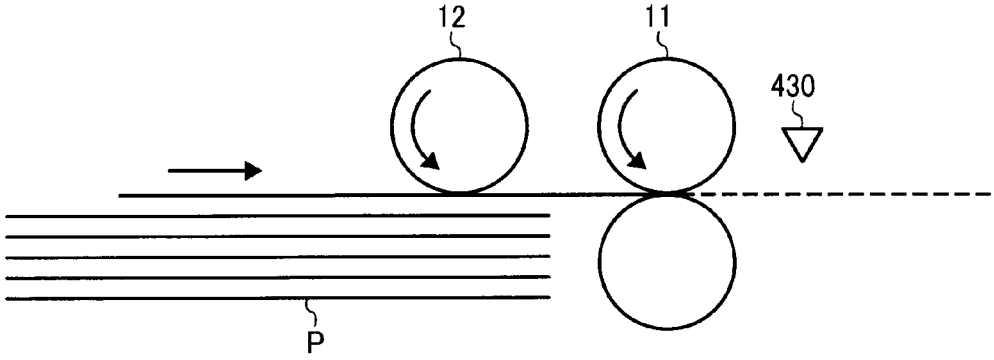
FIG. 4 is a side view of the conveying mechanism according to the first embodiment.

FIG. 3 is a schematic diagram illustrating a general configuration of the conveying mechanism 420. FIG. 4 is a side view of the conveying mechanism 420. The conveying mechanism 420 mainly includes a feed roller 11 and a pick-up roller 12 as conveying members.

The motor 410 drives the feed roller 11 and the pick-up roller 12 to rotate. The motor 410 is, for example, a stepping motor, a brushless motor, or the like. The feed roller 11 and the pick-up roller 12 are driven to rotate by the motor 410, thereby leading a sheet P into the conveying unit 8.

The motor 410 changes the rotation speed under the control of a control unit 115. In a slip measuring mode to be described later, the motor 410 increases the rotation speed thereof to a higher rotation speed than that is in a normal mode. This makes the rotating members rotate faster or the belt move faster. Therefore, a sheet is more likely to slip than it is in the normal mode.

The sensor 430 is installed on the conveying path, and detects a leading edge of a sheet P being conveyed on the conveying path in a conveying direction shown in FIG. 3. Incidentally, the sensor 430 is used to detect a slip; alternatively, it may be configured to use the sensor 430 to detect a sheet jam.

More specifically, the sensor 430 detects the presence or absence of the sheet P or the leading edge of the sheet P at a predetermined point. The sensor 430 may be installed at, for example, two points on the conveying path in the feed unit 1. So, a time taken for the sheet P or the leading edge of the sheet P to pass between the two points can be measured.

To return to FIG. 2, the conveyance control unit 100 controls driving of the motor 410 of the feed unit 1. Furthermore, the conveyance control unit 100 determines whether there is an indication of abnormality in the conveying member of the conveying mechanism 420 in the feed unit 1 on the basis of information detected by the sensor 430, and outputs the information to the operation panel 200 via the I/O control unit 300.

As shown in FIG. 2, the conveyance control unit 100 mainly includes: the control unit 115; a determining unit 119; a pulse generating unit 116; a driver 118; a memory 120; and a measuring unit 117.

The control unit 115 controls the operation of the entire conveyance control unit 100. Furthermore, the control unit 115 switches between the normal mode and the slip measuring mode. The normal mode here is a mode in which a sheet is conveyed for normal image forming operation, such as printing of an image by the image forming apparatus including the conveying device or acquisition of image data by the scanner including the conveying device.

The slip measuring mode is a mode in which the force acting on the sheet P is changed to be different from that is in the normal mode, and a sheet P is conveyed in a slip-prone state to predict the occurrence of a slip in the normal mode.

In the first embodiment, the control unit 115 changes, as the force acting on the sheet P, the conveying force exerted on the sheet P in the normal mode to the conveying force in the slip measuring mode. More specifically, the control unit 115 controls the rotation speed of the motor 410 via the pulse generating unit 116, and increases the conveyance speed of the sheet P to the higher conveyance speed than that is in the normal mode, thereby changing the conveying force exerted on the sheet P in the normal mode to the conveying force in the slip measuring mode.

When the determining unit 119 determines that a sheet P in the feed unit 1 is more likely to slip, the control unit 115 further changes the rotation speed of the motor 410 or the like. This helps reduce the occurrence of a trouble such as a sheet jam.

The pulse generating unit 116 generates a pulse related to a period of rotation of the motor 410 in accordance with a command from the control unit 115. The pulse generated by the pulse generating unit 116 is output to the driver 118. In the slip measuring mode, the pulse generating unit 116 generates a pulse of a shorter wavelength than a pulse generated in the normal mode. This increases the conveyance speed of the sheet P, and as a result, the conveying force exerted on the sheet P increases. Furthermore, the pulse generating unit 116 outputs a pulse of the same wavelength as the pulse output to the driver 118 to the measuring unit 117.

The driver 118 drives the motor 410 to rotate on the basis of the pulse output from the pulse generating unit 116 in accordance with the instruction from the control unit 115.

The measuring unit 117 detects a time at which a leading edge of a sheet P comes to a detecting position of the sensor 430 installed in the feed unit 1 with the conveyance speed of the sheet P increased on the basis of an output from the sensor 430. The sensor 430 outputs a signal indicating that the leading edge of the sheet P has arrived. Then, the measuring unit 117 measures, as a measurement value related to the conveyance speed of the sheet, a time between the predetermined timing and a time when the sensor 430 outputs the signal. Specifically, the measuring unit 117 counts the number of pulses output from the pulse generating unit 116 in a time between the predetermined timing and a time when the sensor 430 outputs the signal.

The predetermined timing here is, for example, a time when execution of the slip measuring mode is instructed by an operator or a serviceperson or a time when any change in a sheet being conveyed is detected and thereby the slip measuring mode is initiated. Furthermore, the predetermined timing may be, for example, a time when conveyance of a sheet begins in the slip measuring mode, a time when a job to convey a sheet is instructed, or the like. Moreover, the predetermined timing may be set at intervals of a certain period of time.

Incidentally, when a plurality of the sensors 430 are installed in the feed unit 1, the measuring unit 117 measures a time on a sensor-by-sensor basis. Information on the time is associated with each sensor. In this case, specifically, the measuring unit 117 counts the number of pulses output from the pulse generating unit 116 in a time in which the leading edge of the sheet P passes between the sensors 430.

In the slip measuring mode, the determining unit 119 determines whether there is an indication of abnormality in the conveying member of the conveying mechanism 420 on the basis of information from the sensor 430.

Specifically, in the slip measuring mode, the determining unit 119 determines whether the number of pulses counted by the measuring unit 117 is greater than a predetermined threshold value to determine whether the conveyance speed of the sheet P is higher than a predetermined speed. Then, when the number of pulses exceeds the predetermined threshold value, the determining unit 119 determines that it is in a state prone to abnormality such as a jam of the sheet P, i.e., there is an indication of abnormality. When determining that it is in an abnormality-prone state, the determining unit 119 sends information about this to the I/O control unit 300 thereby causing the information to be displayed on the display unit 220 of the operation panel 200.

Incidentally, in the first embodiment, in the slip measuring mode, whether the conveyance speed of a sheet is higher than the predetermined speed is determined on the basis of a sheet conveyance time obtained by counting the number of pulses; alternatively, it may be configured to install a speed sensor or the like so that the speed sensor detects the conveyance speed of a sheet directly The memory 120 is a storage medium for storing therein a current mode of the image forming apparatus (the normal mode or the slip measuring mode) and the predetermined threshold value used when the determining unit 119 determines whether it is in an abnormality-prone state.

Figure 5:
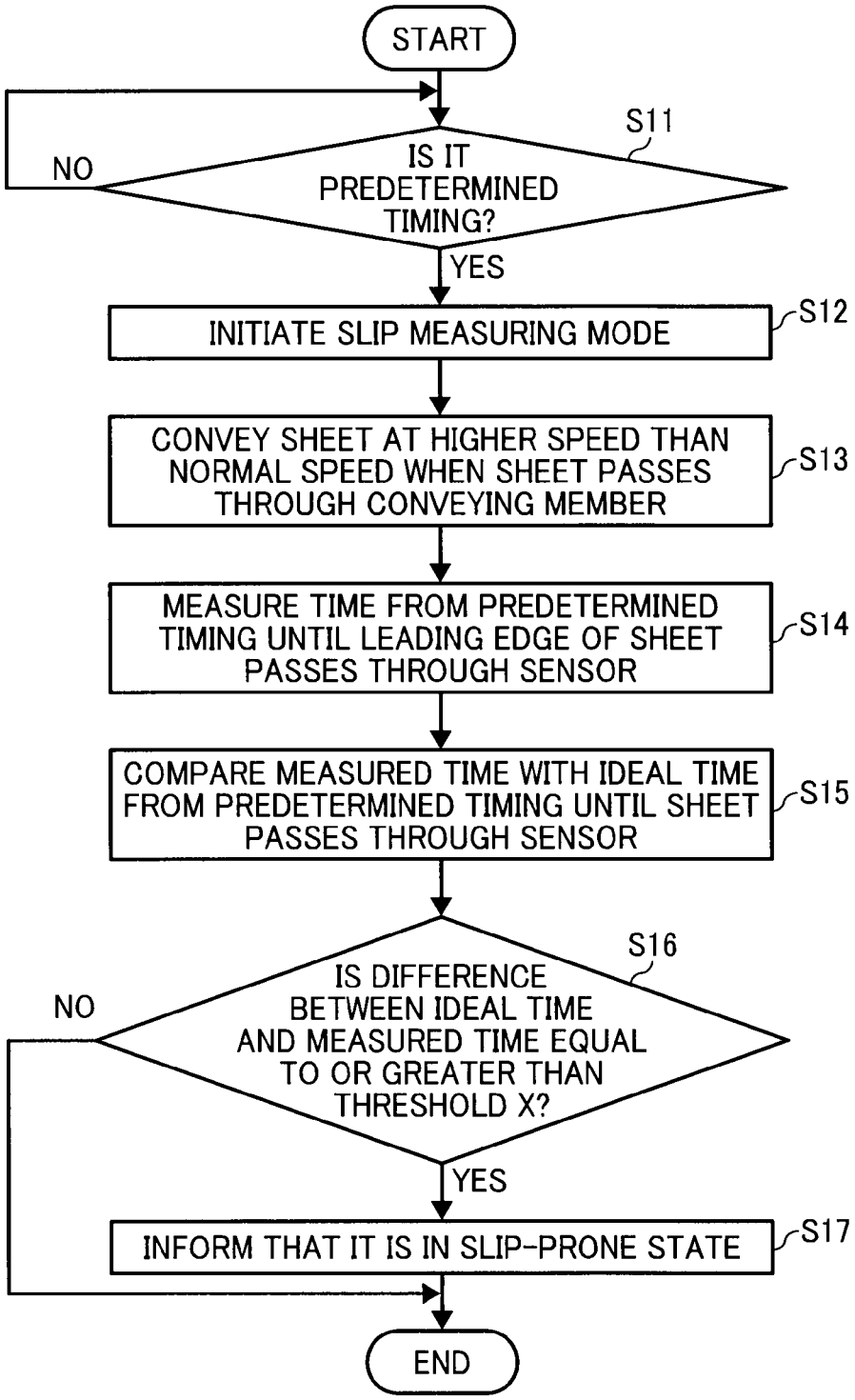
FIG. 5 is a flowchart showing a procedure of a conveyance control process according to the first embodiment.

Subsequently, a conveyance control process performed by the image forming apparatus according to the first embodiment, which is configured as described above, is explained. FIG. 5 is a flowchart showing a procedure of the conveyance control process according to the first embodiment. In FIG. 5, at intervals of the predetermined timing, the presence or absence of abnormality in the conveying member is checked.

At Step S11 in FIG. 5, the control unit 115 determines whether it is the predetermined timing. Then, when it is the predetermined timing (YES at Step S11), the flow proceeds to Step S12; on the other hand, when it is not the predetermined timing (NO at Step S11), the flow repeats Step S11.

At Step S12 subsequent to Step S11, the pulse generating unit 116 shortens the wavelength of a pulse to be generated to be shorter than the wavelength in the normal mode. This increases the conveyance speed of a sheet P, and as a result, the conveying force exerted on the sheet increases, and the slip measuring mode is initiated.

At Step S13 subsequent to Step S12, when the sheet passes through the conveying member driven by the motor 410, the sheet is conveyed at the higher speed than that is in the normal mode because the wavelength of the pulse for driving the motor 410 is shortened at Step S12. This speed is a speed which does not cause a slip if the conveying member has an initial friction coefficient μ.

At Step S14 subsequent to Step S13, the measuring unit 117 measures a time from the predetermined timing at Step S11 until a leading edge of the sheet passes through the detecting position of the sensor 430.

At Step S15 subsequent to Step S14, the determining unit 119 determines the presence or absence of abnormality on the basis of the time T' measured on the basis of the number of pulses at Step S14 and a predetermined ideal time T. Namely, a difference between the measured time T' and the ideal time T (T'−T) is calculated.

Incidentally, the predetermined ideal time T is expressed by the following equation (1).

$$T=(\text{a distance between the measurement start position and the detecting position of the sensor 430})/(\text{the ideal sheet speed}) \quad (1)$$

In the above equation (1), "the ideal sheet speed" is a speed when no abnormality occurs.

At Step S16 subsequent to Step S15, whether the difference between the measured time T' and the ideal time T (T'−T) is equal to or greater than a predetermined threshold value X stored in the memory 120 is determined. When the difference (T'−T) is equal to or greater than the threshold value X, the flow proceeds to Step S17; on the other hand, when the difference (T'−T) is smaller than the threshold value X (NO at Step S17), the process is terminated.

At Step S17 subsequent to Step S16, the control unit 115 informs the I/O control unit 300 that it is in a slip-prone state. This information is, for example, data of a screen generated by the control unit 115. This leads the display unit 220 of the operation panel 200 to display thereon a message that it is in a slip-prone state to an operator.

Incidentally, when the motor 410 is a stepping motor, at Steps S14 and S16 described above, the number of drive pulses may be directly used instead of the time. Namely, a difference between "the number of drive pulses P' from the measurement start position until the sensor 430 detects the sheet" and "the ideal number of drive pulses P from the measurement start position until the sensor 430 detects the sheet" (P'−P) is calculated. At Step S16, the difference (P'−P) is compared with the threshold value X.

The sheet P conveyed in the slip measuring mode may be discharged into a purge tray. Furthermore, in the case of a printer, the sheet may be conveyed into a duplex conveying path so that the sheet can be used at the time of next printing in the normal mode.

A reason why abnormality is detected by increasing the speed in the slip measuring mode will be explained below.

First, a conveying force F, the force with which the rotating member such as the feed roller 11 and the pick-up roller 12 moves a sheet P, is expressed by F=μN. Here, "μ" denotes a coefficient of friction between the rotating member and the sheet P; "N" denotes the normal force. Due to wear of the feed roller 11 or the pick-up roller 12 or attachment of a foreign substance to the surface of the feed roller 11 or the pick-up roller 12, a value of the friction coefficient μ decreases, and a value of F decreases, resulting in a slip. The friction coefficient μ also has the property of decreasing with increase in the rotation speed of the feed roller 11 and the pick-up roller 12. Incidentally, in fact, the friction coefficient μ does not change with the conveyance speed; however, an area of contact between the sheet P and the rotating member such as the feed roller 11 and the pick-up roller 12 becomes smaller with increasing the conveyance speed, so the frictional force is reduced.

Thus, according to the first embodiment, a sheet P is more likely to slip by increasing the conveyance speed of the sheet P, and it becomes easier to detect a change in the friction coefficient μ due to wear or the like, and therefore, an indication of a slip, which cannot be detected at the conveyance speed of the sheet P in the normal mode, can be detected in the slip measuring mode.

Incidentally, in determination of the threshold value X used for determining the presence or absence of abnormality, a change in μ due to wear and a change in μ due to the conveyance speed are taken into account. The threshold value X may preferably set to a value where: at the speed in the slip measuring mode some kind of slip occurs; however at the speed in the normal mode a slip which becomes a problem such as a sheet jam does not occur.

Second Embodiment

In the first embodiment, an indication of abnormality in the conveying member is determined after switching to the slip measuring mode in which the force acting on a sheet P is changed by increasing the conveying force exerted on the sheet P, i.e., the conveyance speed of the sheet P. In a second embodiment, an indication of abnormality in the conveying member is determined after switching to the slip measuring mode in which the force acting on a sheet P is changed is made by applying the pressing force to the sheet P. More specifically, in the second embodiment, in the slip measuring mode, the rotation speed of a roller on the upstream side in the conveying direction of the sheet P is reduced to the lower rotation speed than that of a conveyance roller subject to judgment about an indication of abnormality, thereby applying the pressing force to the sheet P.

Furthermore, in the second embodiment, there is shown an example in which the conveying device according to the present invention is applied not to the feed unit 1 but to the conveying unit 8.

Figure 6:
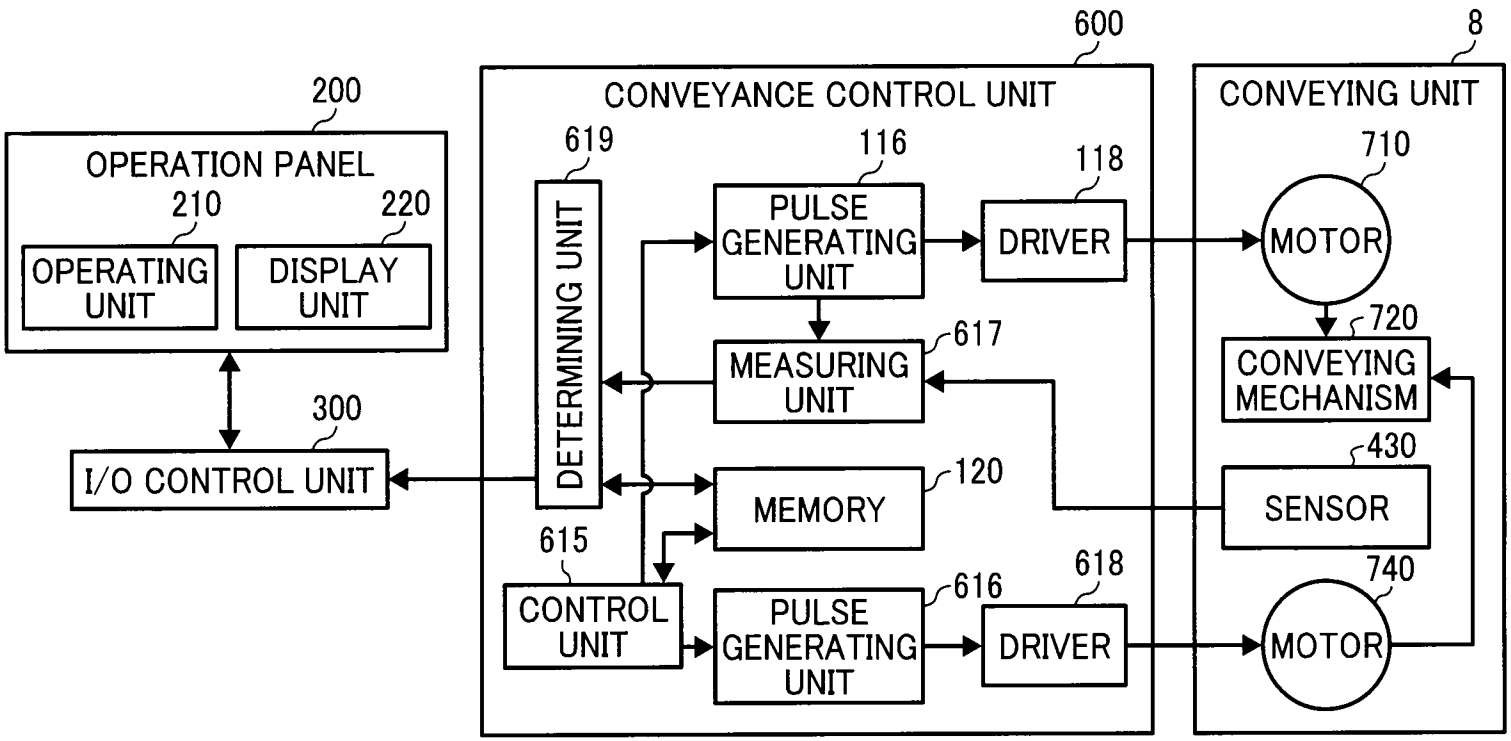
FIG. 6 is a block diagram illustrating functional configurations of a conveyance control unit and an operation panel according to a second embodiment.

FIG. 6 is a block diagram illustrating functional configurations of a conveyance control unit 600 for controlling driving of the conveying unit 8 as the conveying device and the operation panel 200. The functions and configurations of the operation panel 200 and the I/O control unit 300 here are identical to those in the first embodiment.

As shown in FIG. 6, the conveying unit 8 mainly includes: a motor 710; a conveying mechanism 720; the sensor 430; and a motor 740. The function and configuration of the sensor 430 in the second embodiment is identical to that is in the first embodiment.

Figure 7:
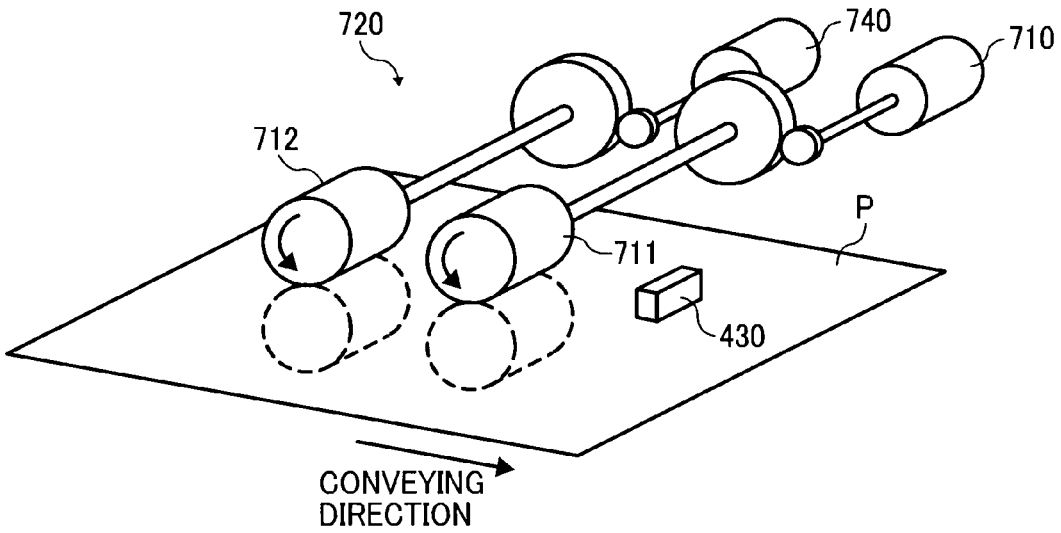
FIG. 7 is a schematic diagram illustrating a general configuration of a conveying mechanism according to the second embodiment.

FIG. 7 is a schematic diagram illustrating a general configuration of the conveying mechanism 720. The conveying mechanism 720 of the conveying unit 8 mainly includes, as the conveying member, two conveyance rollers 711 and 712 on the conveying path. The conveyance roller 712 is arranged on the upstream side in the conveying direction of a sheet P, and the conveyance roller 711 is arranged on the downstream side in the conveying direction of the sheet P. The conveyance roller 711 is the roller subject to judgment about an indication of abnormality in the slip measuring mode.

The motor 710 drives the conveyance roller 711 to rotate. The motor 740 drives the conveyance roller 712 to rotate.

To return to FIG. 6, the conveyance control unit 600 controls driving of the motors 710 and 740 of the conveying unit 8. Furthermore, the conveyance control unit 600 determines whether there is an indication of abnormality in the conveying member of the conveying mechanism 720 in the conveying unit 8 on the basis of information detected by the sensor 430, and outputs the information to the operation panel 200 via the I/O control unit 300.

As shown in FIG. 6, the conveyance control unit 600 mainly includes: a control unit 615; a determining unit 619; the pulse generating unit 116; the driver 118; the memory 120; a measuring unit 617; a pulse generating unit 616; and a driver 618. The functions and configurations of the pulse generating unit 116, the driver 118, and the memory 120 in the second embodiment are identical to those in the first embodiment.

The driver 118 drives the motor 710 to rotate on the basis of a pulse output from the pulse generating unit 116 in accordance with an instruction from the control unit 615.

The pulse generating unit 616 generates a pulse related to a period of rotation of the motor 740 in accordance with a command from the control unit 615. The pulse generated by the pulse generating unit 616 is output to the driver 618.

The driver 618 drives the motor 740 to rotate on the basis of the pulse output from the pulse generating unit 616 in accordance with an instruction from the control unit 615.

The control unit 615 controls the operation of the entire conveyance control unit 600. Furthermore, the control unit 615 switches between the normal mode and the slip measuring mode. In the second embodiment, the control unit 615 controls so that in the slip measuring mode, the pressing force is applied to a sheet P as the force acting on the sheet P. More specifically, when the switching to the slip measuring mode is made, the control unit 615 reduces the rotation speed of the motor 740 to the lower rotation speed than that of the motor 710 which drives the conveyance roller 711 via the pulse generating unit 616, thereby reducing the rotation speed of the upstream-side conveyance roller 712 to the lower rotation speed than that of the downstream-side conveyance roller 711. As a result, the pressing force is applied to the sheet P, and the sheet P is more likely to slip.

Based on an output from the sensor 430, the measuring unit 617 detects a time at which a leading edge of the sheet P reaches the detecting position of the sensor 430 installed in the conveying unit 8 in a state the rotation speed of the upstream-side conveyance roller 712 is lower than that of the downstream-side conveyance roller 711, i.e., in the slip measuring mode. The concrete way to detect the time is the same as in the first embodiment.

In the slip measuring mode, the determining unit 619 determines whether there is an indication of abnormality in the conveying member of the conveying mechanism 720 on the basis of information received from the sensor 430.

Specifically, in the slip measuring mode in which the rotation speed of the upstream-side conveyance roller 712 is reduced to the lower rotation speed than that of the downstream-side conveyance roller 711; in order to determine whether the conveyance speed of the sheet P is higher than a predetermined speed; the determining unit 619 determines whether the number of pulses counted by the measuring unit 617 is greater than a predetermined threshold value. Then, when the number of pulses exceeds the predetermined threshold value, the determining unit 619 determines that it is in a state prone to abnormality such as a jam of the sheet P, i.e., there is an indication of abnormality. When determining that it is in an abnormality-prone state, the determining unit 619 sends information, to the same effect, to the I/O control unit 300 thereby causing the information to be displayed on the display unit 220 of the operation panel 200.

Figure 8:
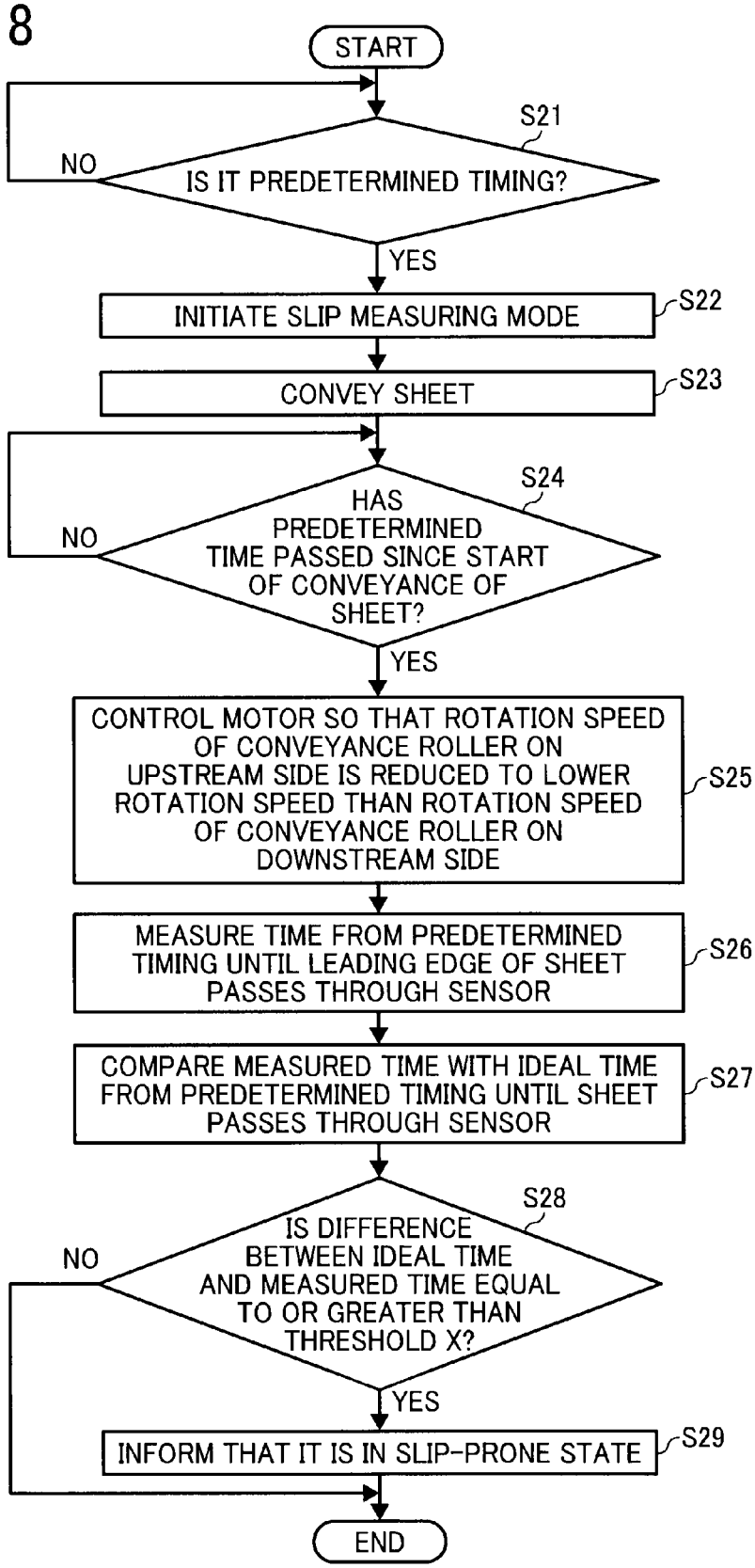
FIG. 8 is a flowchart showing a procedure of a conveyance control process according to the second embodiment.

Subsequently, a conveyance control process performed by the image forming apparatus according to the present embodiment, which is configured as described above, will be explained. FIG. 8 is a flowchart showing a procedure of the conveyance control process according to the second embodiment.

At Step S21 in FIG. 8, the control unit 615 determines whether it is the predetermined timing. Then, when it is the predetermined timing (YES at Step S21), the flow proceeds to Step S22; on the other hand, when it is not the predetermined timing (NO at Step S21), the flow repeats Step S21. The predetermined timing is the same as that of the first embodiment.

At Step S22 subsequent to Step S21, the control unit 615 makes the transition from the normal mode to the slip measuring mode.

At Step S23 subsequent to Step S22, when the slip measuring mode is initiated, a sheet is conveyed from the feed unit 1 to the conveying unit 8. When the conveyance of the sheet P is started, the downstream-side conveyance roller 711 and the upstream-side conveyance roller 712 rotate at almost the same rotation speed. Then, at Step S24, the control unit 615 waits the passage of a predetermined period of time since the start of the conveyance of the sheet (NO at Step S24). The predetermined period of time here is a time from the start of the conveyance of the sheet until the sheet becomes in a state sandwiched between the conveyance rollers 711 and 712 when the sheet is conveyed at the normal conveyance speed, and is set in advance and stored in the memory 120.

At Step S24, when the predetermined period of time has passed since the start of the conveyance of the sheet (YES at Step S24), the sheet becomes in a state of sandwiched between the conveyance rollers 711 and 712, so, at Step S25, the control unit 615 causes the pulse generating unit 616 to generate a pulse so as to reduce the rotation speed of the motor 740 to the lower rotation speed than that of the motor 710 which drives the conveyance roller 711. Consequently, the control unit 615 reduces the rotation speed of the upstream-side conveyance roller 712 to the lower rotation speed than that of the downstream-side conveyance roller 711.

Then, at Step S26 subsequent to Step S25, the measuring unit 617 measures a time from the predetermined timing at Step S21 until a leading edge of the sheet passes through the detecting position of the sensor 430. The processes at Steps S27 to S29 are performed in the same manner as Steps S15 to S17 in the first embodiment.

A reason why abnormality is detected by reducing the rotation speed of the upstream-side conveyance roller 712 in the slip measuring mode will be explained below.

In the same manner as in the first embodiment, a conveying force F, the force with which the rotating member such as the conveyance rollers 711 and 712 moves a sheet P, is expressed by $F=\mu N$ ($\mu$: a coefficient of friction between the rotating member and the sheet, N: the normal force). Due to wear of the conveyance rollers 711 and 712 or attachment of a foreign substance to the surface of any of the conveyance rollers 711 and 712, a value of the friction coefficient $\mu$ decreases, and a value of F decreases, resulting in a slip.

When the sheet P is conveyed by the two conveyance rollers 711 and 712 having the same friction coefficient, if the rotation speed of the rear conveyance roller, i.e., the upstream-side conveyance roller 712 is reduced to the lower rotation speed than that of the front conveyance roller, i.e., the downstream-side conveyance roller 711, an area of contact between the upstream-side conveyance roller 712 and the sheet becomes larger than an area of contact between the downstream-side conveyance roller 711 and the sheet. The larger the area of contact, the larger the frictional force; so, the apparent friction coefficient increases, and the force acts in a direction of pressing the sheet.

When the force acts in the direction of pressing the sheet, a force $F'=\mu'N'$ in a direction opposite to the conveying direction acts on the sheet. Here, "μ'" denotes a coefficient of friction between the conveyance rollers 711 and 712 and the sheet; "N'" denotes the normal force between the conveyance rollers 711 and 712 and the sheet. A force for conveying the sheet is (F−F'), and it is smaller than the force F in normal mode.

Therefore, according to the second embodiment, the rotation speed of the upstream-side conveyance roller 712 is reduced thereby applying the pressing force to a sheet, and the sheet is more likely to slip due to a change in g caused by wear of the conveyance roller 711, and abnormality can be detected.

Third Embodiment

In the second embodiment, in the slip measuring mode, the rotation speed of the conveyance roller on the upstream side in the conveying direction of a sheet P is reduced to the lower rotation speed than that of the conveyance roller subject to judgment about an indication of abnormality, thereby applying the pressing force to the sheet P, and whether there is an indication of abnormality is determined. In a third embodiment, in the slip measuring mode, the pressing force is directly applied to a sheet by a presser roller as a pressing member, and whether there is an indication of abnormality is determined.

Furthermore, in the third embodiment, there is shown an example in which the conveying device according to the present invention is applied to the conveying unit 8.

Figure 9:
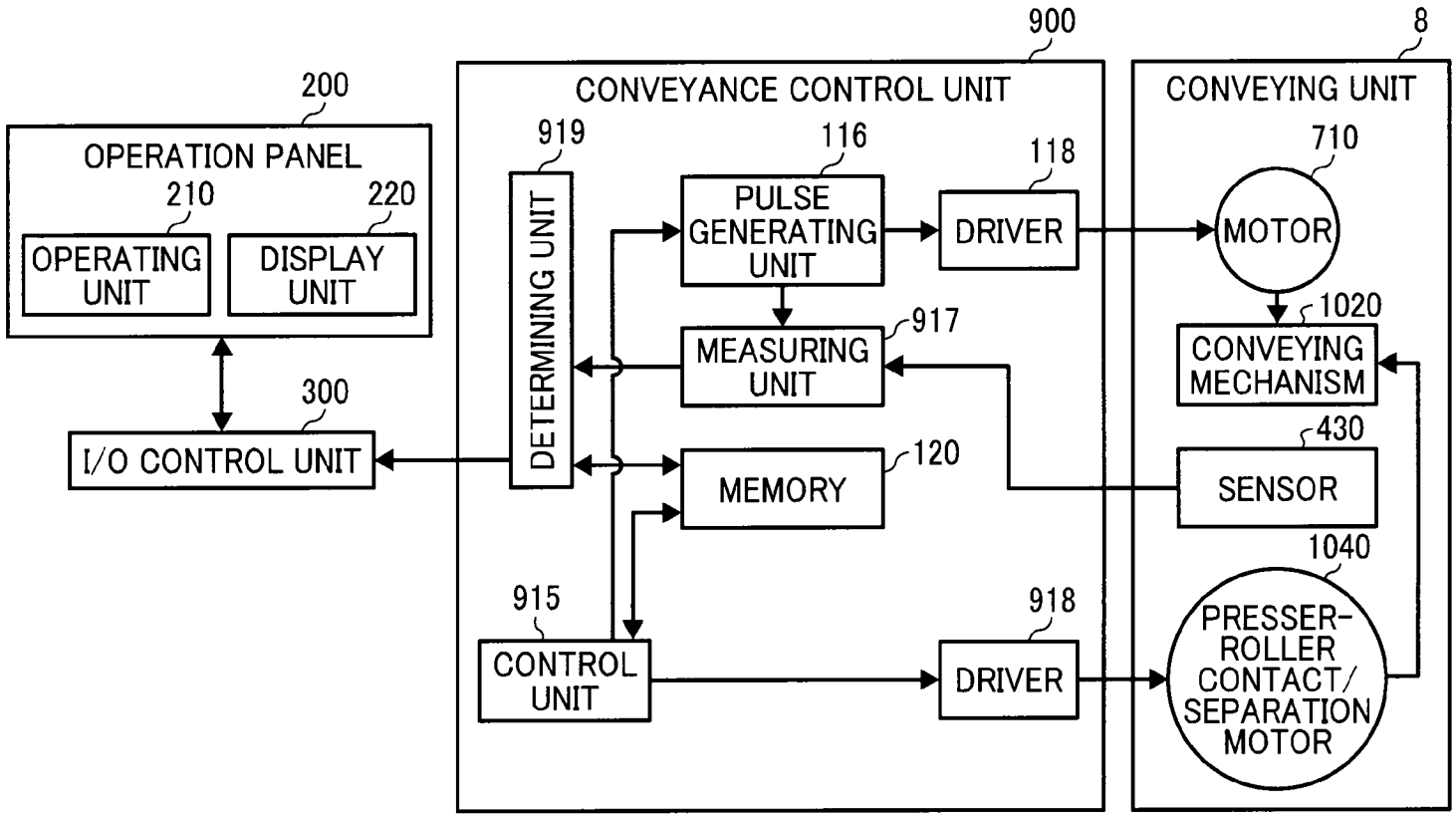
FIG. 9 is a block diagram illustrating functional configurations of a conveyance control unit and an operation panel according to a third embodiment.

FIG. 9 is a block diagram illustrating functional configurations of a conveyance control unit 900 for controlling driving of the conveying unit 8 as the conveying device and the operation panel 200. The functions and configurations of the operation panel 200 and the I/O control unit 300 here are identical to those in the first embodiment.

As shown in FIG. 9, the conveying unit 8 mainly includes: the motor 710; a conveying mechanism 1020; the sensor 430; and a presser-roller contact/separation motor 1040. The function and configuration of the sensor 430 here is identical to that is in the first embodiment.

Figure 10:
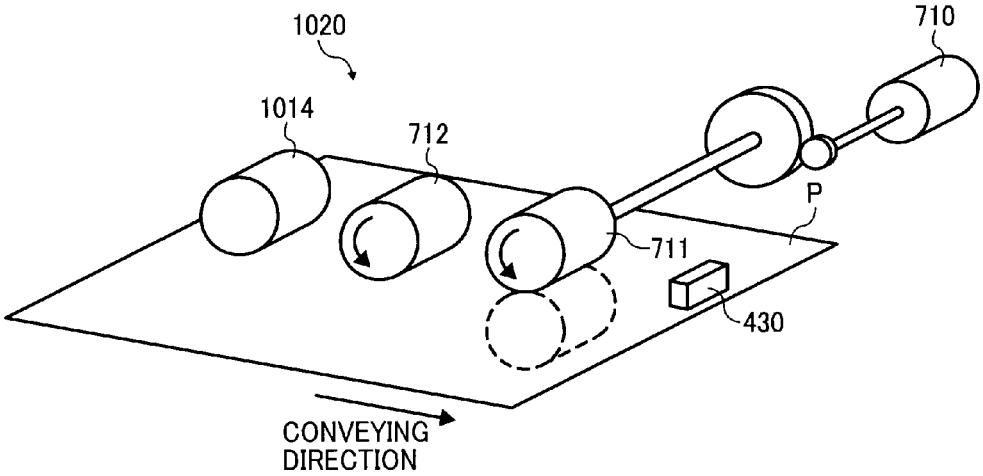
FIG. 10 is a schematic diagram illustrating a general configuration of a conveying mechanism according to the third embodiment.

FIG. 10 is a schematic diagram illustrating a general configuration of the conveying mechanism 1020. The conveying mechanism 1020 of the conveying unit 8 mainly includes, as the conveying member, the two conveyance rollers 711 and 712 on the conveying path and, as the pressing member, a presser roller 1014. The function and configuration of the sensor 430 here is identical to that is in the first embodiment, and the functions and configurations of the conveyance rollers 711 and 712 and the motor 710 here are identical to those in the second embodiment. Incidentally, in FIG. 10, the illustration of the motor which drives the conveyance roller 712 to rotate is omitted.

The presser roller 1014 is a movable roller capable of coming in contact with and moving away from a sheet P being conveyed on the conveying path, and is driven to come in contact with or move away from the sheet by the presser-roller contact/separation motor 1040. When the presser roller 1014 comes in contact with the sheet P, the pressing force is applied to the sheet P. Incidentally, instead of the motor, solenoid may be used to drive the presser roller 1014.

To return to FIG. 9, the conveyance control unit 900 controls driving of the motor 710 and the presser-roller contact/separation motor 1040 of the conveying unit 8. Furthermore, the conveyance control unit 900 determines whether there is an indication of abnormality in the conveying member of the conveying mechanism 1020 in the conveying unit 8 on the basis of information detected by the sensor 430, and outputs the information to the operation panel 200 via the I/O control unit 300.

As shown in FIG. 9, the conveyance control unit 900 mainly includes: a control unit 915; a determining unit 919; the pulse generating unit 116; the driver 118; the memory 120; a measuring unit 917; and a driver 918. The functions and configurations of the pulse generating unit 116, the driver 118, and the memory 120 here are identical to those in the first embodiment.

The driver 918 drives the presser-roller contact/separation motor 1040 in accordance with an instruction from the control unit 915, thereby causing the presser roller 1014 to come in contact with or move away from the sheet P.

The control unit 915 controls the operation of the entire conveyance control unit 900. Furthermore, the control unit 915 switches between the normal mode and the slip measuring mode. In the third embodiment, the control unit 915 controls so that in the slip measuring mode, the pressing force is applied to a sheet P as the force acting on the sheet P. More specifically, when the transition to the slip measuring mode is made, the control unit 915 drives the presser-roller contact/separation motor 1040 so as to cause the presser roller 1014 to come in contact with the sheet P, thereby applying the pressing force in a vertical direction to the sheet P, resulting in a decrease in acceleration in the conveying direction at the pressed site, and the sheet P is more likely to slip.

The measuring unit 917 detects a time at which a leading edge of the sheet P arrives at the detecting position of the sensor 430 installed in the conveying unit 8 with the pressing force applied to the sheet P by the presser roller 1014, i.e., in the slip measuring mode on the basis of an output from the sensor 430. The concrete way to detect the time is the same as in the first embodiment.

In the slip measuring mode, the determining unit 919 determines whether there is an indication of abnormality in the conveying member of the conveying mechanism 1020 on the basis of information received from the sensor 430.

Specifically, in the slip measuring mode in which the pressing force is applied to the sheet P by the presser roller 1014, the determining unit 919 determines whether the number of pulses counted by the measuring unit 917 is greater than a predetermined threshold value to determine whether the conveyance speed of the sheet P is higher than a predetermined speed. Then, when the number of pulses exceeds the predetermined threshold value, the determining unit 919 determines that it is in a state prone to abnormality such as a jam of the sheet P, i.e., there is an indication of abnormality. When determining that it is in an abnormality-prone state, the determining unit 919 sends information, to the same effect, to the I/O control unit 300 thereby causing the information to be displayed on the display unit 220 of the operation panel 200.

Figure 11:
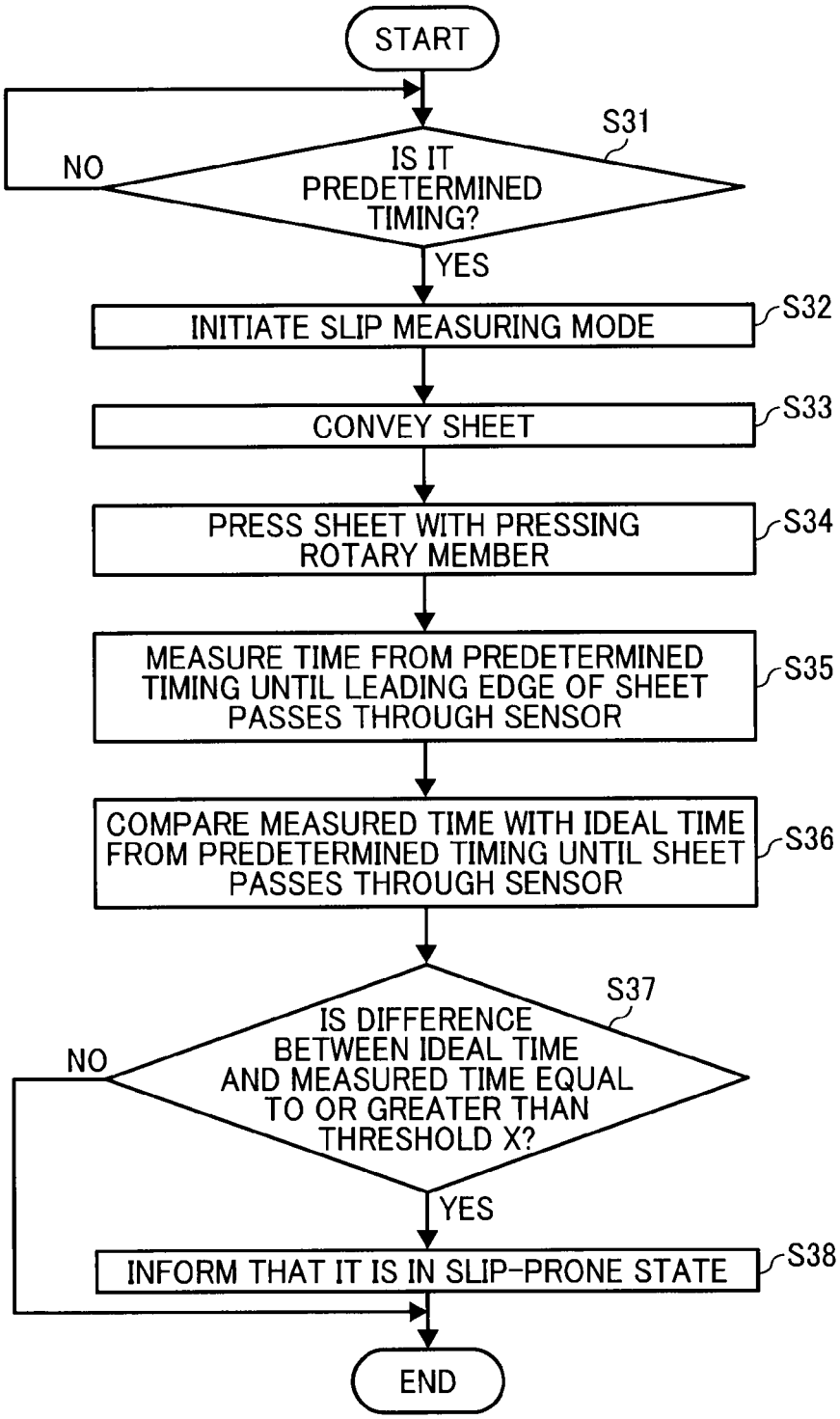
FIG. 11 is a flowchart showing a procedure of a conveyance control process according to the third embodiment.

Subsequently, a conveyance control process performed by the image forming apparatus according to the third embodiment, which is configured as described above, is explained. FIG. 11 is a flowchart showing a procedure of the conveyance control process according to the third embodiment.

In FIG. 11, at intervals of the predetermined timing, the presence or absence of abnormality in the conveying member is checked. At Step S31 in FIG. 11, the control unit 915 determines whether fit is the predetermined timing.

When it is the predetermined timing (YES at Step S31), the flow proceeds to Step S32; on the other hand, when it is not the predetermined timing (NO at Step S31), the flow repeats Step S31. At Step S32 subsequent to Step S31, the slip measuring mode is initiated.

At Step S33 subsequent to Step S32, the conveyance of a sheet P is started. More specifically, a sheet is picked up from a sheet tray, and led into the conveying unit 8.

At Step S34 subsequent to Step S33, the presser-roller contact/separation motor 1040 is driven in accordance with an instruction from the control unit 915, and the sheet P is pressed by the presser roller 1014.

The processes at Steps S35 to S38 subsequent to Step S34 are identical to the processes at Steps S14 to S17 in the first embodiment, so the description of these steps is omitted.

A reason why abnormality is detected by pressing a sheet P in the slip measuring mode will be explained below.

A force F with which the conveying member moves a sheet is expressed by $F=\mu N$. Here, "μ" denotes a coefficient of friction between the conveying member and the sheet; "N" denotes the normal force. Due to wear of the conveying member or attachment of a foreign substance to the surface of the conveying member, a value of μ decreases, so a value of F also decreases, resulting in a slip.

On the other hand, by pressing the sheet, a force $F'=\mu'N'$ in a direction opposite to the conveying direction acts on the sheet. Here, "μ'" denotes a coefficient of friction between the presser roller 1014 and the sheet; "N'" denotes the normal force between the presser roller 1014 and the sheet. A force for conveying the sheet is $(F-F')$, and it is smaller than the force F in normal mode.

Therefore, the sheet is more likely to slip due to a change in μ caused by wear of the conveying member, and abnormality can be detected.

Variation

Figure 12:
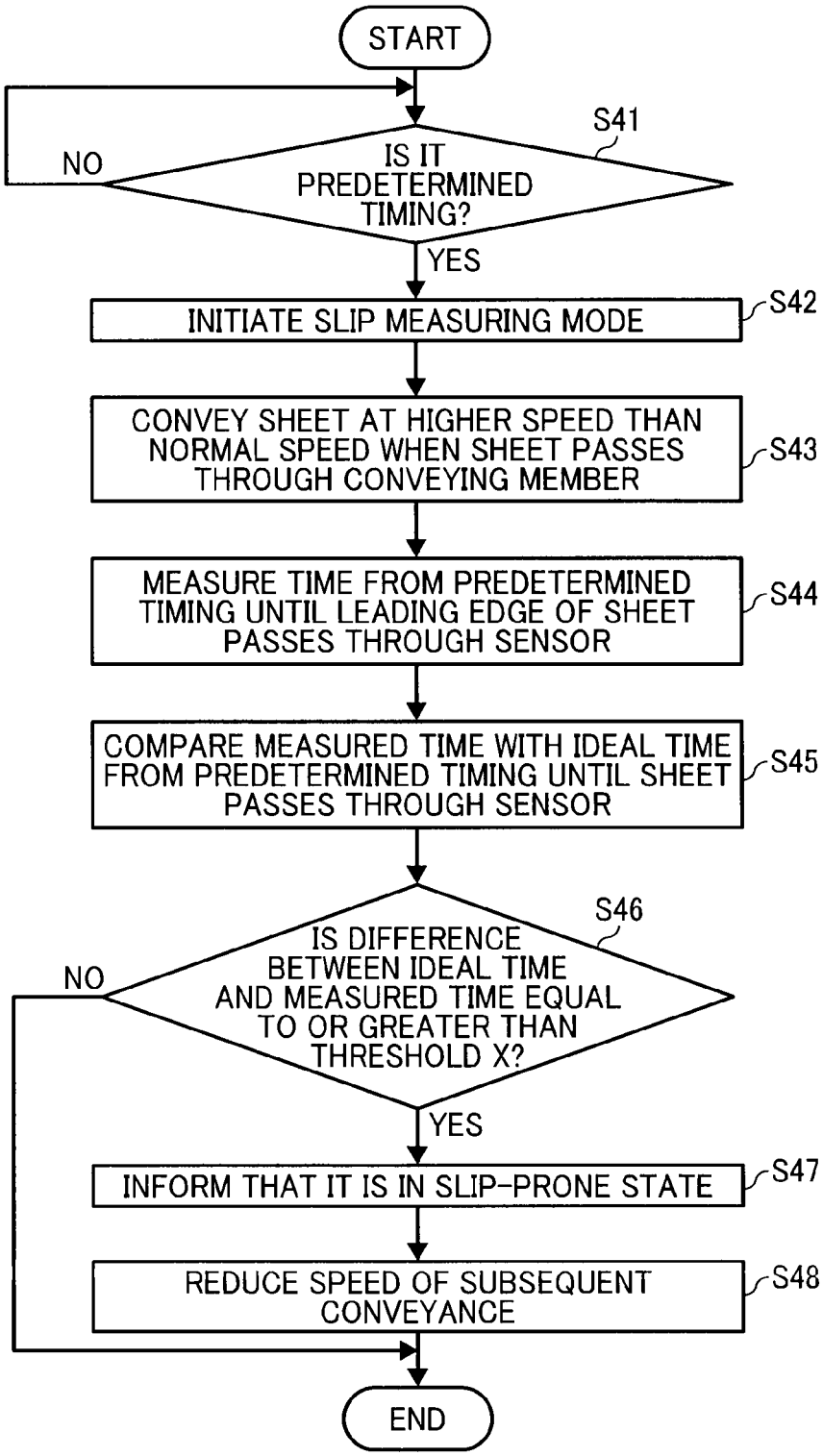
FIG. 12 is a flowchart showing a procedure of a conveyance control process according to a variation.

FIG. 12 is a flowchart showing a procedure of a conveyance control process according to a variation. The conveyance control process according to the present variation includes a process of reducing the conveyance speed of a sheet P by the control unit 115 if the occurrence of abnormality is predicted. The processes at Steps S41 to S47 are identical to the processes at Steps S11 to S17 in the first embodiment, so the description of these steps is omitted.

At Step S48 subsequent to Step S47, at the time of subsequent conveyance of a sheet P, the wavelength of a pulse generated by the pulse generating unit 116 is lengthened. This reduces the conveyance speed of the sheet P and increases the friction coefficient μ, so the sheet is less likely to slip.

Incidentally, in FIG. 12, there is shown an example in which the present variation is applied to the first embodiment; alternatively, the present variation can be applied to the conveyance control processes according to the second and third embodiments.

Implementation by Computer, etc.

Incidentally, conveyance control programs executed by the image forming apparatuses according to the first to third embodiments and the variation are each preliminarily built into a ROM or the like.

Alternatively, the conveyance control programs executed by the image forming apparatuses according to the first to third embodiments and the variation may be provided in such a manner that the conveyance control program is recorded on a computer-readable recording medium, such as a CD-ROM, a flexible disk (FD), a CD-R, or a digital versatile disk (DVD), in an installable or executable file format.

Furthermore, the conveyance control programs executed by the image forming apparatuses according to the first to third embodiments and the variation may be provided in such a manner that the conveyance control program is stored on a computer connected to a network, such as the Internet, so that a user can download the conveyance control program via the network. Moreover, the conveyance control programs executed by the image forming apparatuses according to the first to third embodiments and the variation may be provided or distributed via a network, such as the Internet.

The conveyance control programs executed by the image forming apparatuses according to the first to third embodiments and the variation are each composed of modules including the above-described units (the control unit, the measuring unit, the determining unit, the driver, and the like). As actual hardware, a CPU (a processor) reads out the conveyance control program from the ROM and executes the conveyance control program, thereby the above units are loaded on a main storage unit, and the control unit, the measuring unit, the determining unit, the driver, and the like are generated on the main storage unit.

The best modes for the working of the invention are described above; however, the present invention is not limited to the embodiments described in the best modes. Change(s) can be made without departing from the spirit and scope of the present invention.

According to the present invention, it is possible to detect abnormality in conveyance of a recording medium at an early stage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A conveying device comprising:

a conveying unit that conveys a recording medium;

a detecting unit that detects the recording medium being conveyed;

a control unit that controls to change a force acting on the recording medium from a force that is acting on the recording medium during normal conveyance of the recording medium, and the control unit is configured to increase a conveyance speed of the recording medium to change a friction force acting on the recording medium;

a detecting unit configured to detect slipping of the recording medium due to the change in friction force;

a measuring unit that measures a measurement value related to the conveyance speed of the detected recording medium with the acting force changed; and a determining unit that determines whether there is an indication of abnormality in conveyance of the recording medium on the basis of the measurement value.

2. The conveying device according to claim 1, wherein the control unit changes the acting force by changing a conveying force exerted on the recording medium, and the measuring unit measures the measurement value with the conveying force changed.

3. The conveying device according to claim 2, wherein the control unit changes the conveying force by increasing the conveyance speed of the recording medium, and the measuring unit measures the measurement value with the conveyance speed increased.

4. The conveying device according to claim 1, wherein the control unit changes the acting force by applying a pressing force to the recording medium, and the measuring unit measures the measurement value with the pressing force applied to the recording medium.

5. The conveying device according to claim 1, wherein the control unit reduces the conveyance speed of the recording medium if the determining unit determines that there is an indication of abnormality in the conveyance of the recording medium.

6. The conveying device according to claim 1, wherein the measuring unit measures, as the measurement value, a time between predetermined timing and a point of detection of the recording medium by the detecting unit, and the determining unit determines that there is an indication of abnormality in the conveyance of the recording medium if the time is equal to or longer than a predetermined threshold value.

7. The conveying device according to claim 1, wherein the determining unit determines whether the recording medium is more likely to slip during the conveyance of the recording medium as determination of the indication of abnormality.

8. The conveying device according to claim 1, wherein the control unit changes the force acting on the recording medium from that is in a normal mode in which the normal conveyance of the recording medium is performed if a mode of conveying the recording medium is made the transition from the normal mode to a measuring mode in which determination of the indication of abnormality is performed.

9. An image forming apparatus comprising:

a conveying device that conveys a recording medium; and an image forming unit that forms an image on the recording medium being conveyed, wherein the conveying device includes a conveying unit that conveys a recording medium;

a detecting unit that detects the recording medium being conveyed;

a control unit that controls to change a force acting on the recording medium from a force that is acting on the recording medium during normal conveyance of the recording medium, and the control unit is configured to increase a conveyance speed of the recording medium to change a friction force acting on the recording medium;

a detecting unit configured to detect slipping of the recording medium due to the change in friction force;

a measuring unit that measures a measurement value related to conveyance speed of the detected recording medium with the acting force changed; and a determining unit that determines whether there is an indication of abnormality in conveyance of the recording medium on the basis of the measurement value.

10. A non-transitory computer-readable medium storing computer readable instructions thereon that when executed by a computer cause the computer to perform a method comprising:

detecting a recording medium being conveyed;

controlling to change a force acting on the recording medium from a force that is acting on the recording medium during normal conveyance of the recording medium;

increasing a conveyance speed of the recording medium to change a friction force acting on the recording medium;

detecting slipping of the recording medium due to the change in friction force;

measuring a measurement value related to conveyance speed of the detected recording medium with the acting force changed; and determining whether there is an indication of abnormality in conveyance of the recording medium on the basis of the measurement value.

* * * * *